US006832893B2

(12) United States Patent
Chevrefils et al.

(10) Patent No.: US 6,832,893 B2
(45) Date of Patent: Dec. 21, 2004

(54) BLADE PASSIVE COOLING FEATURE

(75) Inventors: Andre Chevrefils, Chateauguay (CA); Que Dan Pham, Montreal (CA)

(73) Assignee: Pratt & Whitney Canada Corp., Quebec (CA)

( * ) Notice: Subject to any disclaimer, the term of this patent is extended or adjusted under 35 U.S.C. 154(b) by 25 days.

(21) Appl. No.: 10/278,899

(22) Filed: Oct. 24, 2002

(65) Prior Publication Data

US 2004/0081556 A1 Apr. 29, 2004

(51) Int. Cl.[7] ..... F01D 5/08
(52) U.S. Cl. ..... 416/95; 416/193 A
(58) Field of Search ..... 416/95, 96 R, 416/193 A

(56) References Cited

U.S. PATENT DOCUMENTS

| | | | | |
|---|---|---|---|---|
| 2,656,147 A | * | 10/1953 | Denison et al. | 416/193 A |
| 2,858,103 A | * | 10/1958 | Waugh | 416/193 A |
| 3,066,910 A | * | 12/1962 | Bluck | 416/193 A |
| 3,804,551 A | | 4/1974 | Moore | |
| 4,017,210 A | | 4/1977 | Darrow | |
| 4,457,668 A | * | 7/1984 | Hallinger | 416/95 |
| 5,271,718 A | | 12/1993 | Mitchell, Jr. et al. | |
| 5,344,283 A | * | 9/1994 | Magowan et al. | 416/193 A |
| 5,639,216 A | * | 6/1997 | McLaurin et al. | 416/95 |
| 5,800,124 A | | 9/1998 | Zelesky | |
| 5,947,687 A | | 9/1999 | Mori et al. | |
| 6,017,189 A | | 1/2000 | Judet et al. | |
| 6,065,932 A | | 5/2000 | Dodd | |
| 6,120,249 A | | 9/2000 | Hultgren et al. | |

FOREIGN PATENT DOCUMENTS

| | | |
|---|---|---|
| EP | 0 937 863 | 8/1999 |
| EP | 0 940 561 | 8/1999 |
| EP | 1 028 228 | 8/2000 |
| EP | 1 122 405 | 8/2001 |
| GB | 2 165 007 | 4/1986 |

* cited by examiner

*Primary Examiner*—Edward K. Look
*Assistant Examiner*—Igor Kershteyn
(74) *Attorney, Agent, or Firm*—Ogilvy Renault

(57) ABSTRACT

A passively cooled blade platform for a gas turbine rotor adapted for rotation about an axis within a stationary coolant fluid. The platform has a radially outer surface defining an annular gas path, a radially inner surface in flow communication with the coolant fluid, a leading edge, and a trailing edge. The inner surface includes at least one cooling flow channel in the inner surface. Each channel has a flow path from a channel inlet to a channel outlet, preferably with a tangential component at the inlet opposite to the direction of rotation and an axial component at the outlet. The flow channels are defined by ribs or pedestals extending radially inwardly from the platform inner surface to direct cooling fluid flow and create turbulence to dissipate heat from the platform on exposure to cooling fluid flow.

17 Claims, 4 Drawing Sheets

BLADE PASSIVE COOLING FEATURE

TECHNICAL FIELD

The invention relates to a passively cooled blade platform for a gas turbine rotor with cooling channels in an inner surface thereof to direct cooling fluid flow from the surrounding relatively stationary cooling fluid.

BACKGROUND OF THE ART

Gas turbine engines utilize a portion of the compressed air generated by the compressor to cool engine components with compressed cooling air flow, such as through the turbine blades and blade platforms. Spent cooling air eventually rejoins the hot gas path flow and is ejected from the engine with the exhaust.

In some instances however, use of forced compressed air cooling is not possible or imposes an undesirable penalty on the engine efficiency. The invention is directed to passive cooling, as opposed to active or forced cooling flow, that results from the moving of a hot engine part within a relatively static coolant thereby creating a relative fluid flow and cooling effect. One of the applications of passive cooling is to cool the blade platform lip of a turbine blade as it rotates in a relative stationary volume of cooling air.

U.S. Pat. No. 6,065,932 to Dodd shows an example of using the rotation of the turbine to exhaust spent coolant from the underside of turbine blade platforms and prevent the accumulation of heat. In this example, the motion of the turbine is utilized to create sufficient vacuum to exhaust spent coolant and maintain a flow of coolant through the platform area.

U.S. Pat. No. 5,800,124 to Zelesky shows a forced air cooling of the trailing edge lip of a turbine blade platform using a portion of cooling air flow directed at the underside of the blade platform.

It is an object of the present invention to provide passive cooling of the blade platform to eliminate the need for forced coolant use and to extend the life of the blade platform through more efficient cooling.

Further objects of the invention will be apparent from review of the disclosure, drawings and description of the invention below.

DISCLOSURE OF THE INVENTION

The invention provides a passively cooled blade platform for a gas turbine rotor adapted for rotation about an axis within a stationary coolant fluid. The platform has a radially outer surface defining an annular gas path, a radially inner surface in flow communication with the coolant fluid, a leading edge, and a trailing edge with at least one cooling flow channel in the inner surface. Each channel has a flow path from a channel inlet to a channel outlet, with a tangential component at the inlet opposite to the direction of rotation and an axial component at the outlet. The flow channels are defined by ribs or pedestals extending radially inwardly from the platform inner surface to direct cooling fluid flow and create turbulence. The ribs reinforce the platform structurally, and together with the pedestals serve to dissipate heat from the platform on exposure to cooling fluid flow.

DESCRIPTION OF THE DRAWINGS

In order that the invention may be readily understood, one embodiment of the invention is illustrated by way of example in the accompanying drawings.

Further details of the invention and its advantages will be apparent from the detailed description included below.

DETAILED DESCRIPTION OF PREFERRED EMBODIMENTS

Figure 1:
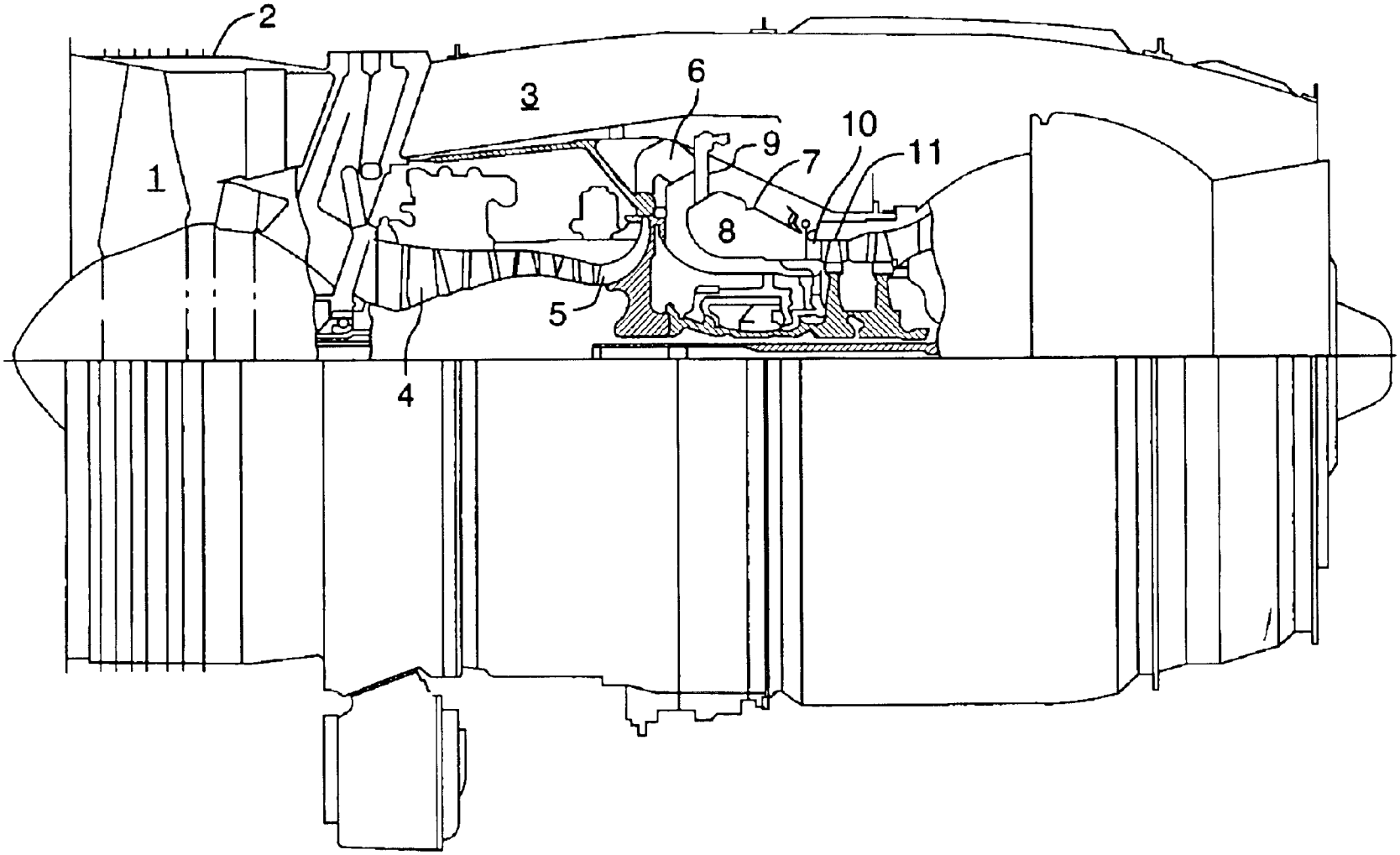
FIG. 1 is an axial cross sectional view through a typical turbofan gas turbine engine showing the locations of common components to such an engine including the location of high pressure turbines which can benefit from the application of passive cooling.

FIG. 1 shows an axial cross-section through a turbo-fan gas turbine engine. It will be understood however that the invention is equally applicable to any type of engine with a combustor and turbine section such as a turbo-shaft, a turbo-prop, or auxiliary power units. Air intake into the engine passes over fan blades 1 in a fan case 2 and is then split into an outer annular flow through the bypass duct 3 and an inner flow through the low-pressure axial compressor 4 and high-pressure centrifugal compressor 5. Compressed air exits the compressor 5 through a diffuser 6 and is contained within a plenum 7 that surrounds the combustor 8. Fuel is supplied to the combustor 8 through fuel tubes 9 which is mixed with air from the plenum 7 when sprayed through nozzles into the combustor 8 as a fuel air mixture that is ignited. A portion of the compressed air within the plenum 7 is admitted into the combustor 8 through orifices in the side walls to create a cooling air curtain along the combustor walls or is used for cooling to eventually mix with the hot gases from the combustor and pass over the nozzle guide vane 10 and turbines 11 before exiting the tail of the engine as exhaust.

A portion of the compressed air generated by the low pressure compressor 4 and the high pressure compressor 5 is bled off and utilized for compressed air cooling of the hot sections of the engine core including nozzle guide vanes 10 and the turbines 11 in a manner well known to those skilled in the air. The compressed air used for cooling is eventually rejoined with the hot gases emitted from the combustor 8 as it passes through and is exhausted from the engine. As it will be apparent, however the use of compressed air for cooling purposes involves an efficiency penalty. Energy is utilized to generate the compressed cooling air which is not directly utilized to generate output energy from the turbines. Further, ducting and pumping of cooling air involves a loss of energy, increases the weight and complexity of the engine. For these reasons passive cooling if possible is preferred however areas of the engine where such a method can be utilized are somewhat limited.

The present invention relates to cooling to the blade platform leading edge and cooling edge which are exposed to the hot gas path on the radially outward surface and have a radially inner surface that is in flow communication with compressed cooling air. As the gas turbine rotor rotates about the engine axis, the blade platform leading edge and trailing edge (depending on the engine configuration) may be exposed to a relative stationary volume of coolant on the radially inner surface of the blade platform.

Figure 2:
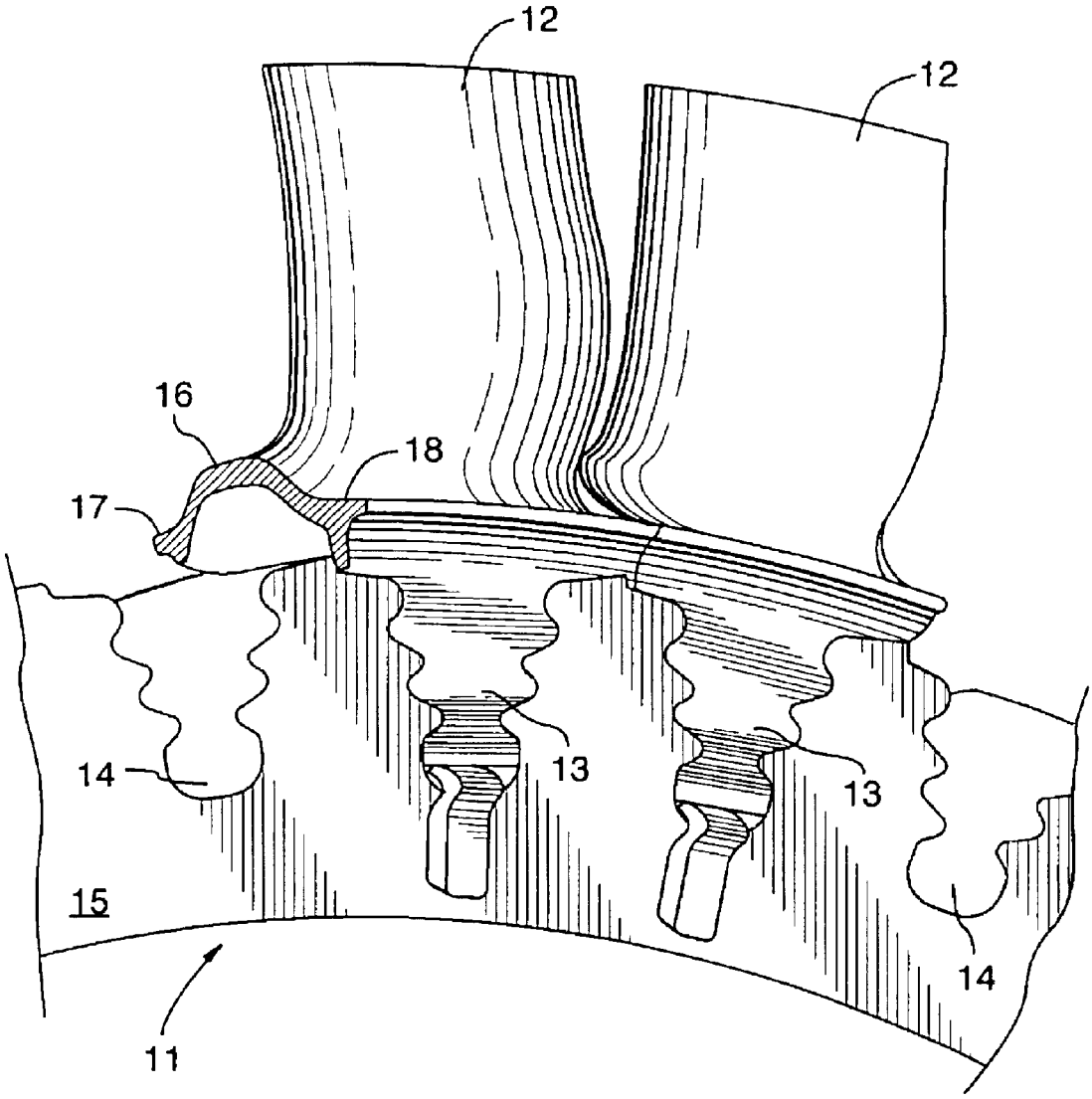
FIG. 2 is a rear perspective view of two blades with blade platforms mounted into slots within a turbine rotor.

FIG. 2 shows a detail of a turbine 11 with turbine blades 12 that include blade roots 13 typically inserted by sliding into a matching slot 14 in the turbine rotor hub 15. The blade platform 16 includes a leading edge 17 and a trailing edge 18. A typical arrangement would include compressed air from the compressors 4 and 5 being ducted to internal channels within the turbine rotor hub 15 (not shown) and then ducted into channels within the blade root 13 and blade 12 for cooling purposes. Cooling air is ejected from the blades 12 through trailing edge openings and rejoins the hot gas path.

In respect of the platforms 16, typically a portion of air circulating through the blade root 13 and blade 12 are also impinged or directed through cooling channels within the platform 16 and may be emitted through the trailing edge 18 or leading edge 17 for cooling purposes.

However, it would be understood that the cooling of the trailing edge 18 and leading edge 17 due to their relatively thin construction and direct exposure to the hot gasses in the hot gas path is a difficult task. The invention provides passing cooling of the trailing edge 18 as an example. It will be understood that the leading edge 17 may also be cooled in a similar manner as the turbine 11 rotates rapidly within a relatively stationary volume of relatively cool compressed air.

Figure 3:
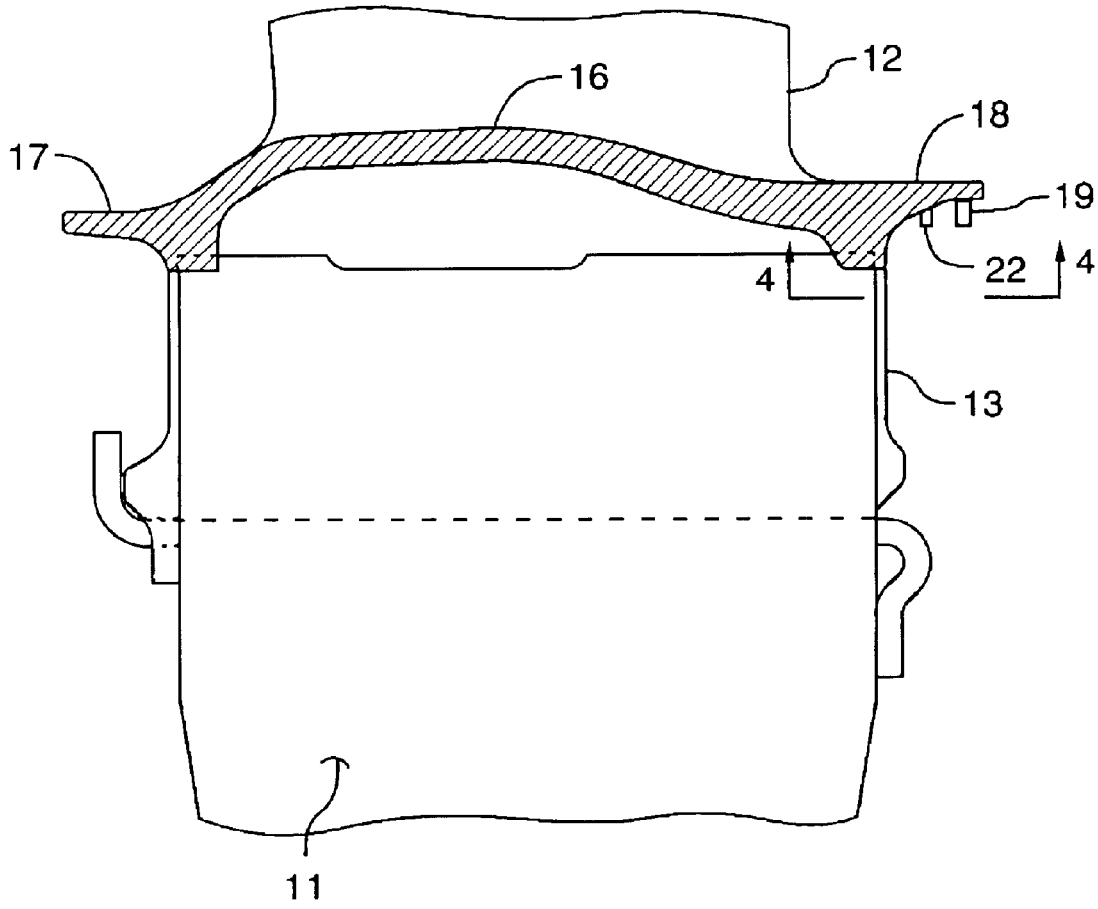
FIG. 3 is an axial sectional view through a blade platform showing the leading edge and trailing edge areas of the blade platform in particular.
Figure 4:
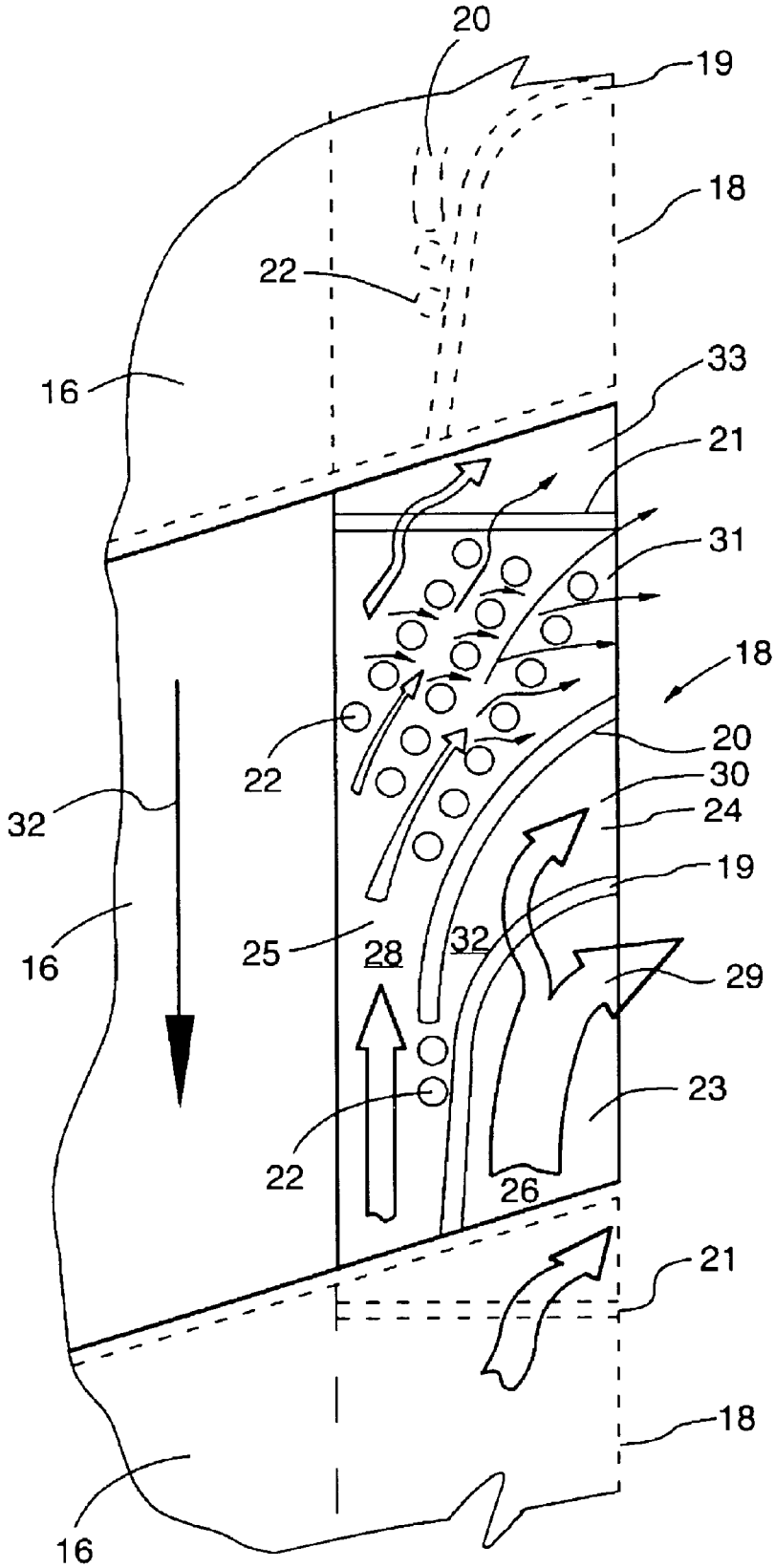
FIG. 4 is a detailed underside view of the blade platform along lines 4—4 of FIG. 3 showing passive cooling features including elongate ribs and cylindrical pedestals that create a flow of coolant as described in detail below.

FIG. 4 in conjunction with FIG. 3 shows the trailing edge 18 which includes a first rib 19, a second rib 20, an axially extending elongate ridge 21 and a series of pedestals 22 that direct a flow of cooling fluid over the trailing edge 18 inner surface as described in detail below.

In the embodiment illustrated, the first rib 19 and second rib 20 as well as the ridge 21 are simply elongate barriers to coolant flow having a rectangular cross sectional profile and the pedestals 22 are illustrated as cylindrical projections extending radially inwardly from the inner surface of the trailing edge 18. It will be apparent however that various other configurations of ribs 19, 20 and ridges 21 and pedestals 22 may be included depending on the coolant flow and turbulence characteristics which the designer wishes to utilize.

In FIG. 4, an arrow indicates the direction of rotation of the turbine rotor and arrows on the trailing edge 18 indicate the resulting flow of coolant passing over the trailing edge 18 as a result.

In the embodiment shown, the trailing edge is divided by barriers to air flow imposed by the ribs 19, 20, ridge 21 and pedestals 22 into cooling flow channels 24, 25, 26 on the inner surface of the trailing edge 18, namely first flow channel 23 second flow channel 24 and third flow channel 25. Each of the channels 23, 24, 25 has a flow path indicated by arrows from a channel inlet 26, 27 and 28 to a channel outlet 29, 30 and 31 respectively. The flow path through each channel 23, 24 and 25 have tangential component at the inlet 26, 27 and 28, opposite to the direction of rotation shown by arrow 32, and has an axial component at the outlet 29, 30 and 31. The ribs 19, 20, pedestal 22 and ridge 21 direct the coolant flow axially to ensure a small, but positive pumping effect and to guide the flow along its flow path towards it trailing edge 18.

Therefore, each flow channel 23, 24, 25 is defined by various barriers to fluid flow such as ribs 19, 20, ridge 21 and pedestals 22 aligned on a boundary of the flow channel 23, 24, 25. The ribs 19, 20 and pedestals 22 project radially inwardly from the inner surface of the trailing edge platform 16 to guide the coolant flow as indicated by arrows in FIG. 4. The pedestals 22 as well as the ridge 21 also serve to induce turbulence. Preferably, the elongate ridge 21 has a height that is less than the height of the ribs 19 and 20 to create a trip strip cooling effect for the hot corner 33 of the trailing edge 18. Air flowing over the ridge 21 impinges in a wave-like turbulent flow on the hot corner 33 and increase heat transfer.

It will be apparent that depending on the extent of cooling required in any particular area of the trailing edge 18 or leading edge 17, different orientations and numbers of pedestals 22, ridges 21 or ribs 19 and 20 may be arranged without departing from the scope of the invention. An example has been described above in providing specialized cooling to the hot corner 33 portion by including a axially extending elongate ridge 21 to create turbulence in the form of a trip strip to improve cooling in that area.

In the embodiment shown in FIG. 4, the flow of air has been divided into three major flow channels 23, 24 or 25, each having a particular pattern of cooling air flow. In the first flow channel 23, a relative large inlet 26 is provided and the curve of the first rib 19 serves to pump air and redirect it from a tangential inlet direction to an axially directed outlet 29. Some of the air flow into the second flow channel 24 enters through the second inlet 27 after passing through pedestals 22 at the inlet 27 and a portion of the flow from the first flow channel 23 escapes over the first rib 19 and joins with air in the second flow channel 24 which is then guided axially by the second rib 20. In the third flow channel 25 the airflow progresses from the third inlet 28 and is directed through the series of pedestals 22 and either passes over the ridge 21 or is ejected axially through the third outlet 31. It will be apparent as well that the structural result of providing ridge 21 and ribs 19 and 20 is to reinforce the trailing edge 18. Also, from a thermodynamic point of view, the projection of pedestals 22, ribs 19 and 20 and ridge 21 from the mass of the trailing edge 18 into the cooling air flow will result in superior cooling and heat transfer since the pedestals 22 ridge 21 and ribs 19, 20 serve as heat sinks to dissipate and transfer heat from the larger mass of the trailing edge 18.

Although the above description relates to a specific preferred embodiment as presently contemplated by the inventors, it will be understood that the invention in its broad aspect includes mechanical and functional equivalents of the elements described herein.

What is claimed is:

1. A passively cooled blade platform, for a gas turbine rotor adapted for rotation in a direction about an axis within a stationary coolant fluid, the platform including:

a radially outer surface defining an annular gas path;

a radially inner surface in flow communication with said coolant fluid;

a leading edge; and a trailing edge with at least one cooling flow channel in said inner surface, the flow channel being open to receive and convey the coolant fluid substantially along the channel in response to said rotation of the blade platform within the stationary coolant fluid.

2. A passively cooled blade platform according to claim 1 wherein:

each channel has a flow path from a channel inlet to a channel outlet, the flow path having a tangential component at the inlet opposite to said direction of rotation and an axial component at the outlet.

3. A passively cooled blade platform according to claim 1 wherein each flow channel is defined by a barrier to flow fluid aligned on a boundary thereof.

4. A passively cooled blade platform according to claim 3 wherein the barrier is an elongate rib projecting radially inwardly from the inner surface of the platform.

5. A passively cooled blade platform according to claim 3 wherein the barrier is a plurality of pedestals projecting radially inwardly from the inner surface of the platform.

6. A passively cooled blade platform according to claim 1 wherein the flow channel includes turbulence inducers projecting radially inwardly from the inner surface of the platform.

7. A passively cooled blade platform according to claim 1 wherein the inner surface of the platform includes an axially extending elongate ridge projecting radially inwardly from the inner surface of the platform.

8. A passively cooled blade platform according to claim 7 wherein the flow channel is defined by a barrier having a height greater than a height of said ridge.

9. A passively cooled blade platform according to claim 1, wherein each flow channel is open to the coolant fluid along the channel's length.

10. A passively cooled blade platform according to claim 1, wherein the at least one channel comprises a plurality of channels.

11. A turbine blade for a gas turbine rotor, the blade adapted for attachment to a turbine rotor and rotation therewith, the blade comprising:

an airfoil;

a blade root; and a platform intermediate the airfoil and the blade root, the platform having an outer surface adjacent the airfoil and an inner surface adjacent the blade root, the inner surface disposed on a portion of the platform adapted to depend from the blade into an adjacent volume of cooling air when the blade is mounted to the rotor, the inner surface including thereon an area to be cooled, the area to be cooled including a plurality of cooling elements protruding from the inner surface, the cooling elements adapted in use to cool said area as a consequence of blade rotation moving the platform though the volume of cooling air.

12. The turbine blade of claim 11, wherein the cooling elements are adapted to induce turbulence in a portion of the volume of cooling air immediately adjacent the area to be cooled.

13. The turbine blade of claim 11, wherein the cooling elements include at least some elements selected form the group comprising pedestals, ridges, ribs and trip strips.

14. The turbine blade of claim 11, wherein the cooling elements are arranged to form at least one cooling channel along the inner surface.

15. The turbine blade of claim 11, wherein the channel is open to the volume of cooling air along the channel's length.

16. The turbine blade of claim 11, wherein the portion of the platform depending from the blade is disposed adjacent a trailing edge of the platform.

17. The turbine blade of claim 11, wherein the cooling elements are adapted to at least partially direct a portion of the volume of cooling air in an axial direction relative to an axis of rotation of the rotor.

* * * * *